United States Patent [19]

Marsan et al.

[11] 4,011,172

[45] Mar. 8, 1977

[54] BLEACHING ARTICLES

[75] Inventors: Mario Stephen Marsan, Cincinnati; Francis Louvaine Diehl, Wyoming; James Byrd Edwards, Cincinnati, all of Ohio

[73] Assignee: The Procter & Gamble Company, Cincinnati, Ohio

[22] Filed: Mar. 27, 1975

[21] Appl. No.: 562,529

[52] U.S. Cl. ..... 252/187 R; 8/108 A; 252/90; 252/95; 252/99; 252/187 H

[51] Int. Cl.[2] ..... C11D 3/395; C11D 7/54; D06L 3/06

[58] Field of Search ..... 252/186, 187 H, 90, 252/95, 99, 316, 317, 187 R; 8/111, 108, 79; 427/242

[56] References Cited

UNITED STATES PATENTS

| | | | |
|---|---|---|---|
| 3,684,722 | 8/1972 | Hynam et al. | 252/99 |
| 3,708,260 | 1/1973 | Marshall et al. | 252/316 |
| 3,726,967 | 4/1973 | Vorsatz et al. | 252/186 |
| 3,789,002 | 1/1974 | Weber et al. | 252/316 |
| 3,843,548 | 10/1974 | James | 252/187 H |

FOREIGN PATENTS OR APPLICATIONS

| | | |
|---|---|---|
| 1,237,199 | 6/1971 | United Kingdom |

*Primary Examiner*—Benjamin R. Padgett
*Assistant Examiner*—Irwin Gluck
*Attorney, Agent, or Firm*—Charles R. Wilson; Jerry J. Yetter; Richard C. Witte

[57] ABSTRACT

Thickened chlorine bleaches, and articles releasably containing same, especially adapted for use in an automatic dryer are provided.

4 Claims, No Drawings

BLEACHING ARTICLES

BACKGROUND OF THE INVENTION

The present invention encompasses compositions and articles designed to bleach fabrics in an automatic dryer. More specifically, thickened chlorine bleaches releasably contained in a porous receptacle are distributed evenly over fabrics by the tumbling action of the automatic clothes dryer.

Compositions and processes designed to provide desirable functional and aesthetic benefits to fabrics are conventionally employed in a washing machine. Thus, fabric sizings, softening agents, bleaches, brighteners, and the like, are commonly formulated and provided as compositions designed for use either in an aqueous laundering liquor or in an aqueous rinse bath. More recently, the treatment of fabrics in automatic clothes dryers has been shown to be an effective means for imparting desirable properties thereto. For example, it is becoming common to soften fabrics in an automatic clothes dryer rather than during the rinse cycle of a laundering operation.

The most familiar method for bleaching fabrics to remove stains, especially in the context of a home laundering operation, is to add an oxidizing bleach directly to the laundering liquor. Liquid chlorine (as hypochlorite) solutions are usually employed, but solid chlorine bleaching compounds are also available. Such bleaches are designed for addition to the laundering bath in conjunction with the detergent, and provide the desired bleaching action concurrently with fabric laundering.

While through-the-wash bleaching processes are effective in most instances, they do suffer from several inherent drawbacks. The addition of either liquid or solid bleaches to the 10–25 gallons of water normally present in an automatic washing machine substantially dilutes the bleach, thereby reducing its effectiveness. For this reason, the quantities of bleach employed in a laundering bath are necessarily high to overcome the dilution effect. Moreover, certain stains can actually be "set" by oxidizing bleaches when used in combination with a detergent in an aqueous bath. For example, blood stains and mineral stains can be darkened by some oxidizing bleaches and become more tenaciously affixed to the fabrics. In such instances, it is more desirable to remove these kinds of stains by washing in the absence of bleach, and to complete the laundering operation by a later bleaching step. Additionally, many oxidizing bleaches contain ingredients which are not compatible with certain components of laundry detergents. Undesirable interactions can ensue when such bleaches and detergents are commingled in the laundering liquor.

The present invention relates to the use of chlorine bleaches, especially hypochlorite solutions, to bleach fabrics, preferably at elevated temperatures, e.g., in a clothes dryer. Chlorine bleaches offer distinct advantages over peroxygen bleaches, inasmuch as they are stronger and perform exceptionally well on heavily stained fabrics.

The concept of bleaching fabrics in a clothes dryer, rather than in an aqueous solution, has been disclosed heretofore. U.S. Pat. No. 3,701,202 describes a dispensing article for use in an automatic clothes dryer and suggests that fabrics may be softened, bleached and otherwise desirably treated in the dryer by means of such an article. See also U.S. Pat. No. 3,180,037.

U.S. Pat. No. 3,843,548, entitled COMPOSITIONS CONTAINING A SOURCE OF HYPOCHLORITE IONS, to R. James, issued Oct. 22, 1974, assigned to Wilkinson Sword, discloses clay-thickened hypochlorite bleaches, but does not disclose their use in the instant articles and processes. Peroxide bleaches thickened with silica gel are known in the hair bleaching art.

The co-pending application of Lucas, McKenna and Diehl, Ser. No. 437,570, filed Jan. 29, 1974, discloses bleaching articles.

The concurrently-filed applications of Bradley and Bradley, et al., Ser. Nos. 562,531 and 562,528, filed March 27, 1975 and March 27, 1975, respectively, relate to starch-thickened peroxygen bleaches and dispensing means therefor.

The concurrently filed application of Diehl, et al., Ser. No. 562,527, filed March 27, 1975, relates to thickened peroxygen bleaches and their use in dryers.

German Pat. No. 2,408,636, published Sept. 5, 1974, U.S. Application 335,311 Feb. 23, 1973, relates to the use of fabric treating agents other than bleaches encapsulated with various organic gelling agents and used, in solid form, in a clothes dryer.

Notwithstanding the potential advantage of bleaching fabrics in a clothes dryer, there are substantial problems with this mode of use. For example, it is essential that dryer-added bleaches be quickly and evenly dispersed over all surfaces of the damp fabrics being dried to insure that even and effective bleaching is obtained. Moreover, an optimal through-the-dryer bleach should not leave solid residues on fabrics.

It has now been found that solutions containing various chlorine bleaches can be thickened and conveniently used in a dryer. The thickened bleaches herein can be employed in porous pouches and are evenly and efficiently released therefrom by the tumbling action of the dryer. In a preferred mode, thickened aqueous solutions of chlorine (as hypochlorite) are used, thereby overcoming any problems with unsightly solid residues being left on the dried fabrics.

It is an object of this invention to provide compositions and articles especially adapted for use as through-the-dryer fabric bleaches.

It is another object herein to provide a means for evenly and efficiently dispensing bleaches onto fabrics in an automatic clothes dryer, or the like, without recourse to complicated dispensers or machine modifications.

These and other objects are obtained herein as will be seen from the following disclosure.

SUMMARY OF THE INVENTION

In its broadest aspect, the present invention encompasses processes for removing stains from fabrics in an automatic dryer comprising commingling pieces of damp fabrics by tumbling said fabrics under heat in a clothes dryer together with an effective amount of a chlorine bleaching composition. The bleaching composition employed herein is thickened and is releasably contained in a simple dispensing means which, by virtue, of the tumbling action of the dryer, rapidly and evenly distributes the bleach over all fabrics surfaces.

DETAILED DESCRIPTION OF THE INVENTION

The bleaching process of the present invention is carried out by contacting damp fabrics with an effective amount of a bleaching composition of the type described hereinafter. It is an essential feature of the present process that the fabrics to be bleached must be damp when contacted by the bleaching composition, inasmuch as water provides the reaction medium in which the bleaching process occurs. The damp fabrics employed in the process are most commonly those secured by washing, rinsing and spin-drying fabrics in any standard washing machine. Such fabrics will contain from about 50% to 200% by weight of water, based on dry fabric weight. Of course, it is most convenient to bleach fabrics in the present manner after a laundering and spin-drying operation and concurrently with drying the laundered fabrics with hot air. Moreover, the heat used to dry fabrics enhances the bleaching action of the chlorine bleaches. The net result of bleaching using the minimal amounts of water retained by the damp fabrics (higher relative effective concentrations of the bleach) and high temperatures (commonly 50° C to 80° C) in the dryer is that superior stain removal performance is secured.

"Spottiness" caused by uneven distribution of bleaches over all fabric surfaces is unacceptable to the user of such products. It will be appreciated that the problem of providing even bleach distribution in the presence of but minimal amounts of water in the manner of the present invention is substantial. This problem becomes particularly acute when a simple, cheap, disposable means for distributing a bleach is desired.

It has now been found that thickened chlorine bleach solutions having a viscosity range as hereinafter disclosed and formulated in combination with a simple dispensing means provide an article which evenly bleaches fabrics in an automatic clothes dryer concurrently with a drying operation. The components of the thickened bleaches and dispersing means which comprise the articles herein are described, in turn, below.

BLEACHING COMPOSITIONS

The chlorine bleach employed herein comprises an active bleaching compound dissolved in water or other suitable solvent and in further combination with a thickener, as described hereinafter. The solution of bleaching compound is most preferably an aqueous solution of chlorine, as hypochlorite, since hypochlorite leaves no solid reaction by-products. Aqueous chlorine solutions containing from about 5% to about 15%, preferably 5% to 10%, by weight of available $cl_2$ at a pH from 9 to 11 are obtained as staple articles of commerce for use herein. Such solutions can optionally be diluted and used herein.

Other chlorine bleaching compounds useful herein include solutions of the common alkali and alkaline earth hypochlorites, hypochlorite addition products, chloramines, chloramides, chlorimines and chlorimides. Specific, non-limiting examples of these chlorine bleaches include sodium hypochlorite, potassium hypochlorite, monobasic calcium hypochlorite, dibasic magnesium hypochlorite, chlorinated trisodium phosphate dodecahydrate, potassium dichloroisocyanurate, trichlorocyanuric acid, sodium dichloroisocyanurate, sodium dichloroisocyanurate dihydrate, 1,3-dichloro-5,5-dimethyl hydantoin, n-chlorosulfamide, chloramine T, dichloramine T, chloramine B and dichloramine B. Of course, it will be recognized that many of the solid, inorganic bleaches can leave solid residues on fabrics. Notwithstanding this problem, such materials are useful in the context of this invention.

The aforesaid bleaching compounds, and mixtures thereof, are preferably used herein at a construction sufficient to provide from about 0.5% to about 15%, preferably 2% to 10%, by weight of available chlorine.

The chlorine bleaching compositions employed in the present articles are thickened, and are characterized by a viscosity (Brookfield) in the range of 200 centipoise (cps) to 100,000 cps, preferably 1000 cps to 20,000 cps. Once thickened, the bleach does not sorb rapidly into fabrics but is distributed over all fabric surfaces by the tumbling action of the dryer. Accordingly, the thickened compositions herein can be introduced into the dryer in any convenient manner, e.g., as an aerosol foam. In a highly preferred mode the thickened bleach is releasably contained within a dispensing means having holes or perforations through which the bleach flows on agitation.

The thickened chlorine bleaches herein are prepared by dissolving the active bleaching compound in water or any desired solvent, e.g., water-ethanol, or the like. The resulting bleach solution is then thickened using any of a number of thickening agents.

Thickening agents for the chlorine bleach solutions herein include, for example, from 10% to 50% by weight of the colloidal silicas, i.e., those having a particle size in the range from about 0.005 microns to about 0.050 microns. These colloidal silicas are further characterized by their high surface area, which is at least about 75 meters$^2$/gram. Colloidal silicas useful herein include both the "low density" and "high density" silicas described in "The Encyclopedia of Chemical Technology" 18, pp. 67 et seq. (1969) Interscience. Such particulate silicas, including silica gels, silica aerogels and other precipitated silicas, are prepared by various aqueous precipitation processes known in the art, e.g., the acid gelation of alkali silicates set forth in U.S. Pat. No. 1,297,724, and are commercially available.

While any particulate silica material having colloidal dimensions and surface areas of at least about 75–100 m$^2$/gram is suitable for use in the articles and processes herein, the "pyrogenic" silicas are preferred. Pyrogenic silicas can be characterized as colloidal, particulate silicas prepared by the hydrolysis of silicon compounds in the vapor phase in a hot, gaseous environment. Such pyrogenic silicas have particle sizes within the range of from about 0.015 microns to about 0.020 microns and have a surface area of at least about 200 m$^2$/gram. Such pyrogenic colloidal silicas having the foregoing physical properties are superior thickeners and are preferred herein for this reason. Pyrogenic colloidal silicas are commercially available under the tradename CAB-O-SIL from the Cabot Corporation, Boston, Massachusetts.

Other agents which can be employed to thicken the bleach solutions herein include the various water-swellable and water-soluble polyacrylamides, and cellulose derivatives such as carboxymethylcellulose, all of which are well known as thickeners and are commercially available. These thickeners are used at a concentration of from about 0.5% to about 8% (wt.) of the present compositions.

The clays taught for use in thickening solutions in U.S. Pat. No. 3,843,548, entitled COMPOSITIONS CONTAINING A SOURCE OF HYPOCHLORITE IONS, James, Oct. 22, 1974, incorporated herein by reference, are also useful herein.

Highly preferred thickening agents herein are the hydrophilic Laponite synthetic clays obtainable from Pfizer, Minerals, Pigments and Metals Division, 235 E.

42nd St., New York, New York 10017. The hydrophilic Laponite clays provide excellent thickening of the bleaching solutions used herein and result in highly stable systems within the specified viscosity range. Although the Laponite clays are solids, they have the unique advantage of apparently drying to a thin, transparent film and are virtually undetectable, even on microscopic analysis of fabrics treated therewith. Accordingly, the hydrophilic Laponite clays have the advantage over other inorganic thickeners, such as the silicas, that they do not leave noticeable solid residues on the fabrics. Moreover, the hydrophilic Laponite clays having a particle size within the range of from about 0.025 microns ($\mu$) to about 50 $\mu$ are known to provide an anti-static and fabric softening benefit, and these benefits can now be secured concurrently with the bleaching action obtained with the instant compositions and articles.

The Laponite clays employed herein are the hydrophilic materials available from Pfizer. These materials are prepared by the coprecipitation and hydrothermal reaction of inorganic compounds to provide a high purity, natural, mineral-like material reminiscent of the hectorites. X-ray analysis indicates that the Laponites are tri-layer minerals, wherein an octahedral magnesia sheet is "sandwiched" between two tetrahedral silica sheets, one on each side, via shared oxygen atoms. The two external layers of the Laponite structure contain oxygen and silicon atoms, whereas the internal layer comprises oxygen, hydroxyl, and magnesium groups. The commercially available Laponite 1001, 1501, 2001, 2101, 2501, 2601, 2002 and 2003 materials contain lithium ions in the middle layer, whereas Laponite 3000 does not.

A typical chemical analysis of hydrophilic Laponite is as follows: $SiO_2$ — 53.9%; MgO — 25.2%; $Li_2O$ — 1.5% F — 5.3%; $Na_2O$ — 3.57%; $Fe_2O_3$ — 0.06%; $Al_2O_3$ — 0.26%; CaO — 0.07%; $SO_3$ — 0.15%; $CO_2$ — 0.19%; structural water — 6.70%.

Along with their x-ray analysis, the Laponite clays are characterized by a high surface area (as measured by nitrogen sorption), usually in the range of about 354 $m^2$/gm; a refractive index of about 1.54; a density of about 2.5 gm/ml; and a free moisture content of about 6%. The preferred Laponites are impalpable, and have a preferred particle size in the range below about 50 microns, preferably 0.025$\mu$ to about 25$\mu$. (The term "impalpable" as used to describe the clay thickeners herein means that the individual clay particles are of a size that they are not perceived tactilely. This is important, since the clay should not render the treated fabric gritty.)

A further description of the hydrophilic Laponite clays along with the physical properties thereof is set forth in the technical manual entitled "Laponite for Thixotropic Gels", available from Pfizer, incorporated herein by reference. Further details regarding the Laponites are set forth in the VOLUNTARY RAW MATERIAL REGISTRATION PROGRAM — FOOD AND DRUG ADMINISTRATION — COSMETIC PRODUCTS, and appear under registration numbers 0011620; 0011621; 0011622 and 0011623.

Smectite clays are another class of thickeners which can be employed in the present compositions, articles and processes. Moreover, the preferred smectite clays also impart desirable softness benefits to fabrics concurrently with the through-the-dryer bleaching operation.

The smectite clays can be decribed as impalpable, expandable, three-layer clays, i.e., alumino-silicates and magnesium silicates, having an ion exchange capacity of at least about 50 meg/100 g. of clay. The impalpable smectite clay particles are preferably within the range below about 50$\mu$. In general, the smectite clays used herein have a particle size within the range of from about 0.025$\mu$ to about 25$\mu$, with the smaller particles being preferred since they are less noticeable on fabric surfaces. The term "expandable" as used to describe clays relates to the ability of the layered clay structure to be swollen, or expanded, on contact with water. Such three-layer expandable clays are classified geologically as smectites.

There are two distinct classes of smectite-type clays useful herein. In the first, aluminum oxide is present in the silicate crystal lattice; in the second class of smectites, magnesium oxide is present in the silicate crystal lattice. The general formulas of these smectites are $Al_2(Si_2O_5)_2(OH)_2$ and $Mg_3(Si_2O)_5(OH)_2$, for the aluminum and magnesium oxide type clays, respectively. It is to be recognized that the range of the water of hydration in the above formulas can vary with the processing to which the clay has been subjected. This is immaterial to the use of the smectite clays in the present compositions in that the expandable characteristics of the hydrated clays are dictated by the silicate lattice structure. Furthermore, atom substitution by iron and magnesium can occur within the crystal lattice of the smectites, while metal cations such as $Na^+$, $Ca^{++}$, as well as $H^+$, can be co-present in the water of hydration to provide electrical neutrality. Except as noted hereinafter, such cation substitutions are immaterial to the use of the clays herein since the desirable bleach thickening and fabric softening properties of the clays are not substantially altered thereby.

The three-layer, expandable alumino-silicates, useful herein are further characterized by a dioctahedral crystal lattice, while the expandable three-layer magnesium silicates have a trioctahedral crystal lattice.

As noted hereinabove, the sectite-type clays employed in the instant compositions can contain cationic counterions such as protons, sodium ions, potassium ions, calcium ion, magnesium ion, and the like. It is customary to distinguish between clays in the basis of one cation predominantly or exclusively absorbed. For example, a sodium clay is one in which the absorbed cation is predominantly sodium. Such absorbed cations can become involved in equilibrium exchange reactions with cations present in aqueous solutions. In such equilibrium reactions, one equivalent weight of solution cation replaces an equivalent weight of sodium, for example, and it is customary to measure clay cation exchange capacity (sometimes called "base exchange capacity") in terms of milliequivalents per 100 g. of clay (meq/100 g.). The cation exchange capacity of clays can be measured in several ways, including electrodialysis, by exchange with ammonium ion followed by titration, or by a methylene blue procedure, all as fully set forth in Grimshaw, *The Chemistry and Physics of Clays*, Interscience Publishers, Inc. pp. 264–265 (1971). The cation exchange capacity of a clay mineral relates to such factors as the expandable properties of the clay, the charge of the clay, which, in turn, is determined at least in part by the lattice structure, and the like. The ion exchange capacity of clays varies widely in the range from about 2 meq/100 g. for kaolinites to about 150 meq/100 g., and greater, for certain clays of the montmorillonite variety. Illite clays have an ion exchange capacity somewhere in the lower portion of the range, ca. 26 meq/100 g. for an average illite clay.

It has been determined that illite and kaolinite clays, with their relatively low ion exchange capacities, do not provide the additional fabric softening benefits characteristic of the smectites, and are not preferred for use herein. Indeed, such illite and kaolinite clays constitute a major component of clay soils. However, smectites, such as nontronite, having an ion exchange capacity of approximately 50 meq/100 g.; saponite, which has an ion exchange capacity of around 70 meq/100 g.; and montmorillonite, which has an ion exchange capacity greater than 70 meq/100 g., are useful thickeners and fabric softeners in the context of this invention. Accordingly, the impalpable, expandable, three-layer smectite-type clays having an ion exchange capcity of at least about 50 meq/100 g. are also useful herein.

The smectite clays used herein are all commercially available. Such clays include, for example, montmorillonite, volchonskoite, nontronite, hectorite, saponite, sauconite, and vermiculite. Such clays are available under commercial names such as "fooler clay" (clay found in a relatively thin vein above the main bentonite or montmorillonite veins in the Black Hills) and various tradenames such as Thixogel No. 1 (also, "Thixo-Jell") and Gelwhite GP from Georgia Kaolin Co., Elizabeth, New Jersey; Volclay BC and Volclay No. 325, from American Colloid Co., Skokie, Illinois; Black Hills Bentonite BH 450, from International Minerals and Chemicals; and Veegum Pro and Veegum F, from R. T. Vanderbilt. It is to be recognized that such smectite-type minerals obtained under the foregoing commercial and tradenames can comprise mixtures of the various discrete mineral entities. Such mixtures of the smectite minerals are suitable for use herein.

While any of the impalpable smectite-type clays having a cation exchange capacity of at least about 50 meq/100 g. are useful herein, certain clays are preferred. For example, Gelwhite GP and "fooler clay" are extremely white forms of smectite clays and are preferred for this reason. Volclay BC, which is a smectite-type clay mineral containing at least 3% iron (expressed as $Fe_2O_3$) in the crystal lattice, and which has a very high ion exchange capacity, is one of the most efficient and effective clays from the standpoint of fabric softening performance. Likewise, Thixogel No. 1 is a preferred clay herein from the standpoint of fabric softening performance. On the other hand, certain smectite clays, such as those marketed under the name "bentonite", are sufficiently contaminated by other silicate minerals that their ion exchange capacity falls below the requisite range, and such clays are of no important use in the instant compositions.

Appropriate smectite clay minerals for use herein can be selected by virtue of the fact that smectites exhibit a true 14A x-ray diffraction pattern. This characteristic pattern, together with exchange capacity measurements, provides a basis for selecting suitable impalpable smectite-type clay minerals for use as thickeners and softeners in the manner of the present invention.

From about 0.5% to about 10%, by weight, of the above clays are used to thicken the instant compositions.

The fabric bleaching compositions and articles herein can optionally contain minor proportions (e.g., 0.1% to about 15% by weight) of various additives which provide additional fabric conditioning benefits. Such additives can include various finishing aids, fumigants, lubricants, fungicides, sizing agents, etc. Specific examples of useful additives can be found in any current Year Book of the American Association of Textile Chemists and Colorists.

The so-called "distribution agents" designed to help evenly deposit materials on fabric surfaces can optionally be employed herein. Such materials include urea, lower carboxylic acids, and the like, all as set forth in British Patent Specification 1,313,697, Rapisarda and Rudy, entitled ADDITIVES FOR CLOTHES DRIERS, Apr. 18, 1973, incorporated herein by reference.

Article Preparation and Usage

The articles of the present invention are prepared by fashioning a receptacle of the type described hereinafter which serves as a dispensing means, and enclosing therein an effective amount of the bleaching composition. By an "effective amount" of the bleaching composition is meant an amount sufficient to remove the stains from an average load of fabrics in an automatic dryer. Of course, the actual amount of the bleaching composition employed will depend on the fabric load, the amount of stain to be removed, and the bleaching composition selected for use in the article. For an average 5 lbs. to 8 lbs. load of medium- to heavily-stained fabrics, from about 10 grams to about 50 grams, preferably 20 grams to 30 grams, of any of the bleaching compositions herein provide good stain removal.

When preparing the articles herein the rate of release of the bleaching compositions from the dispensing means is preferably optimized. The rate of release should not be so fast that the composition is deposited in an uneven manner on the fabrics. Conversely, the rate of release of the bleaching composition must not be too slow, since all, or substantially all, of the composition is preferably dispensed onto the fabrics while they are still damp. The rate of release of the bleaching composition depends on both the viscosity of the bleach composition and the size of the openings in the dispensing means.

The dispensing means herein can be provided in a variety of sizes and shapes, and the particular configuration is not critical to the practice of this invention. For example, a dispensing means can be provided wherein only one wall, or a portion of one wall, comprises a porous opening through which the bleaching composition is dispensed. Preferably the whole of the dispensing means comprises a material provided with openings through which the bleaching composition can pass when agitated, e.g., by the tumbling action of the dryer.

In its simplest and preferred aspect, the dispensing means herein is prepared in the form of a pouch. Preferred dispensing means comprise a flexible embossed plastic pouch containing the bleaching composition. The pouch, which can be made from any water-insoluble plastic sheeting which will maintain its integrity under dryer heat, is formed by folding the embossed sheet into the desired pouch or pouch-like configuration and sealing the edges, for example by heat-sealing, leaving an opening along one edge. The bleaching composition is added to the pouch through the opening, which is then sealed. The resulting pouch is stretched immediately prior to use to cause pores or perforations to open along the embossing lines. The pouch releases the bleaching composition through its now-perforate walls on agitation, e.g., by the tumbling action of an automatic dryer. Suitably embossed plastic sheets for preparing the pouch receptacle include, for example, polyethylene, polypropylene, and the like, and are available from Hercules as INSTANTNET, DELNET brand. When ruptured along the embossed pattern lines, such sheets form pores or perforations in the size range of 0.05 mm-3 mm useful herein.

Alternatively, water-insoluble plastic pouches having perforations in the range of ca. 0.05 mm to ca. 3 mm are used herein. Such pouches can be covered and sealed with plastic film which is removed at time-of-use.

A typical bleaching article herein comprises: (a) a water-insoluble, closed, flexible pouch, the walls of said pouch consisting of uniformly perforated or perforatable polyethylene (e.g., INSTANTNET, above) wherein the diameter of the perforations is about 0.05 mm-0.5 mm; and (b) a bleaching amount of a Laponite-thickened fabric bleaching composition comprising, as the bleaching agent, an aqueous hypochlorite solution containing from 1% to 15% by weight of available chlorine at a solution pH of 8 to 11, said bleaching composition being characterized by a viscosity of 1000 cps to 30,000 cps, preferably 1500 cps–4000 cps.

The articles herein are used in the following manner. Damp fabrics, usually containing from about 1 to 1.5 times their weight of water, are placed in the drum of an automatic clothes dryer. The perforations in the bleaching article are opened and the article is placed in the dryer, which is then operated in standard fashion to dry the fabrics, usually at a temperature from about 50° C to about 80° C for a period of from about 5 minutes to about 50 minutes, depending on the fabric load and type. The tumbling action of the revolving dryer drum commingles the bleaching article with the fabrics and evenly dispenses the bleaching composition on the fabric surfaces.

The most highly preferred articles herein are those having, in use, at least 30% of their total surface area perforated in a more-or-less uniform fashion, and wherein the perforations have a diameter of 0.5 mm to 1 mm. (Such articles can be fashioned from the INSTANTNET, above, or can be perforated at the outset.) When used in the foregoing manner, such articles provide even distribution of the thickened bleaches herein over all fabric surfaces.

The following examples illustrate the present invention but are not intended to be limiting thereof.

EXAMPLE I

An article of the present type comprising a hypochlorite gel in an embossed pouch which opens to provide numerous holes on extension is as follows:

| Ingredient | % (wt.) |
|---|---|
| Aqueous hypochlorite* | 98.0 |
| Laponite 2001 | 1.9 |
| Ethylenediaminetetraacetate, sodium salt (EDTA) | 0.1 |

*As Clorox; ca. 5% available $Cl_2$.

The hypochlorite gel is prepared by simply admixing the aqueous hypochlorite solution, the Laponite clay and the EDTA stabilizer until a homogeneous gelatinous mass is secured.

Twenty grams of the hypochlorite gel secured in the foregoing manner are placed in a pouch. Conveniently, the pouch is ca. 0.08 mm thickness polyethylene embossed in a regular pattern almost to the point of rupture (INSTANTNET, DELNET Brand, Hercules, Inc.). The pouch is in the form of a trapezoid. In use, the pouch is stretched to rupture along the embossed pattern lines, whereupon multiple, ca. 1 mm perforations are opened to provide a means for releasing the gel.

A pouch prepared in the foregoing manner and ruptured along the embossing lines is placed together with 10 lbs. of damp (15 lbs. water) fabrics in a standard automatic clothes dryer. The dryer is operated in standard fashion for 40 minutes at an average temperature of 60° –70° C, with tumbling and venting. Substantially all of the hypochlorite gel is uniformly distributed over the fabrics during the first 5 minutes of tumbling i.e., while the fabrics are still quite damp.

After the drying cycle is complete, the fabrics are removed and are found to have been uniformly bleached, without substantial spotting. The bleaching action is quite comparable to that obtained when commercial hypochlorite solutions are used according to manufacturers' instructions to bleach fabrics in a washing machine.

In the article of Example I, the Laponite 2001 is replaced by an equivalent amount of the following impalpable clays, respectively, and equivalent results are secured: Gelwhite GP; Thixogel No. 1; and Volclay BC. The bleached fabrics are additionally provided with a soft "hand".

EXAMPLE II

An article of the present type comprising a gelled solution of chlorinated trisodium phosphate dodecahydrate (C1TSP) releasably enclosed in a porous pouch is as follows:

| Ingredient | % (wt.) |
|---|---|
| Chlorinated trisodium phosphate | 15.0 |
| Laponite 2001 | 3.0 |
| Water | Balance |

The C1TSP gel is prepared by dissolving the C1TSP in water and adding the Laponite. The mixture is blended until a homogeneous, gelatinous mass is secured.

Twenty grams of the gel prepared in the foregoing manner are placed in a 4 in. × 4 in. porous pouch having ca. 150 holes uniformly over its surface, said holes having an average diameter of ca. 2 mm. The pouch is covered with polyethylene film to retain the gel until time-of-use.

The covering film is removed from a pouch prepared in the foregoing manner, and the pouch is placed together with 10 lbs. of damp (15 lbs. water) fabrics in a standard automatic clothes dryer. The dryer is operated in standard fashion for 40 minutes at an average temperature of 60° C–70° C, with tumbling and venting. Substantially all the C1TSP gel is uniformly distributed over the fabrics during the first 5 minutes of tumbling.

After the drying cycle is complete, the fabrics are removed and tea, coffee and wine stains present thereon are uniformly bleached, without substantial spotting. The bleaching action is quite comparable to that obtained with commercial hypochlorite solutions used according to manufacturers' instructions to bleach fabrics in a washing machine.

In the article of Example II, the C1TSP is replaced by an equivalent amount of sodium dichloroisocyanurate and trichlorocyanuric acid, respectively, and equivalent results are secured.

What is claimed is:

1. An article especially adapted for bleaching fabrics in an automatic clothes dryer, comprising:

a. a thickened chlorine bleaching composition characterized by a viscosity in the range from 200 cps to 100,000 cps wherein the composition has an available chlorine content of from about 0.5% to about 15% by weight and a pH of from 8 to 11 and wherein the composition is thickened with a thickener selected from the group consisting of colloidal silicas, water-swellable and water-soluble polyacrylamides, cellulose derivatives, clays, and mixtures thereof; and b. a water-insoluble dispensing means holding the bleaching composition characterized by being in the form of a pouch having perforations of a diameter from about 0.05 mm to about 3 mm or embossed in such a manner that upon rupture perforations are formed having a diameter of from about 0.05 mm to about 3 mm.

2. An article according to claim 1 wherein the bleaching composition comprises:

a. an aqueous solution of chlorine; and b. from about 0.5% to about 10% by weight of a thickener selected from the group consisting of impalpable hydrophilic clays characterized in being a tri-layered mineral having an octahedral magnesia sheet between two tetrahedral silica sheets via shared oxygen atoms and smectite clays.

3. An article according to claim 2 wherein the clay is characterized by an average particle size in the range below about 50$\mu$.

4. An article according to claim 2 especially adapted to providing controlled release of the fabric bleach in the automatic clothes dryer, comprising:

a. an effective amount of a chlorine bleaching composition having a viscosity in the range of 1000 cps to 20,000 cps, comprising:

i. an aqueous solution having an available chlorine content of from about 2% to about 10% by weight; and ii. wherein the hydrophilic or smectite clay has a particle size below about 50$\mu$; and b. wherein the water-insoluble pouch is embossed in a regular pattern to the point of rupture, whereby, on rupture, at least 30% of the total surface area of the pouch is comprised of holes having an average diameter of from about 0.5 mm to about 1 mm.

* * * * *